United States Patent [19]

Romana

[11] Patent Number: 5,074,414

[45] Date of Patent: Dec. 24, 1991

[54] DISPOSABLE TOOTHBRUSH

[76] Inventor: Juan J. Romaña, 11627 Masonville Dr., Parker, Colo. 80134

[21] Appl. No.: 510,862

[22] Filed: Apr. 18, 1990

[51] Int. Cl.[5] ..... B65D 83/10

[52] U.S. Cl. ..... 206/362.4; 206/229; 206/361; 206/362.2; 206/362.3; 206/472; 206/581; 15/106; 15/184; 15/185

[58] Field of Search ..... 206/38, 229, 232, 361, 206/362.2, 362.3, 362.4, 472, 492, 581; 15/106, 167.1, 184, 185

[56] References Cited

U.S. PATENT DOCUMENTS

| | | | |
|---|---|---|---|
| 1,006,857 | 10/1911 | Ljutica | 15/185 |
| 1,007,864 | 11/1911 | Goldy | 206/362.3 |
| 1,527,853 | 2/1925 | Ferdon | 15/185 |
| 1,537,467 | 5/1925 | Ingle | 206/362.3 |
| 2,353,963 | 7/1944 | Landesman | 15/185 |
| 2,454,995 | 11/1948 | Curran | 206/361 |
| 3,298,507 | 1/1967 | Micciche | 206/361 |
| 4,184,279 | 1/1980 | Peilet | 206/361 |
| 4,482,263 | 11/1984 | Palamara | 15/185 |
| 4,530,129 | 7/1985 | Labick et al. | 206/362.3 |
| 4,800,608 | 1/1989 | Key | 15/167.1 |

FOREIGN PATENT DOCUMENTS

| | | | |
|---|---|---|---|
| 279018 | 2/1927 | United Kingdom | 15/185 |

*Primary Examiner*—David T. Fidei
*Attorney, Agent, or Firm*—Edwin H. Crabtree

[57] ABSTRACT

A disposable toothbrush for travelers, guests of business establishments, and others who need an inexpensive throwaway toothbrush. The toothbrush includes a handle which is folded in the shape of a small angular hollow book. A neck is integrally attached to the handle and folded thereon. A head with bristles is integrally attached to the top of the neck. When the head with bristles and neck are folded inside the hollow handle a compact inexpensive toothbrush is provided.

5 Claims, 1 Drawing Sheet

DISPOSABLE TOOTHBRUSH

BACKGROUND OF THE INVENTION (a) Field of the Invention

The subject invention relates to an inexpensive disposable toothbrush. More specifically the toothbrush can be used once and thrown away or can be reused again and again as desired by the owner.

(b) Discussion of the Prior Art

It is well known in dental health care that a variety of different types of both permanent and disposable toothbrushes are available. The most common permanent toothbrush has a straight handle with a head having bristles extending therefrom for brushing teeth and gums.

In particular U.S. Pat. No. 3,070,102 to MacDonald discloses a novel throw-away toothbrush disposed in a package. When the package is opened the owner places his or her finger on top of an adhesive surface. On the opposite side of the surface is a brush for engaging the teeth. In this toothbrush the finger acts as a handle for the toothbrush.

U.S. Pat. No. 4,530,129 to Labick, et al also discloses a disposable toothbrush with an inexpensive toothbrush with handle, toothpaste, and dental floss received in a plastic case. A wrapper when opened on the case is used to extend the toothbrush outwardly from the case while disengaging the toothpaste and dental floss. None of the prior art disposable toothbrushes provide the unique features of the subject invention as described herein.

SUMMARY OF THE INVENTION

In view of the foregoing, it is an object of the present invention to provide an inexpensive disposable toothbrush that can be thrown away after first use or reused as desired.

It is another object of the present invention to provide various business establishments such as hotels, motels, restaurants, travel agents, and airlines a small and compact travel-type toothbrush when a traveler or visitor has lost or forgotten his or her toothbrush.

Still another object of the invention is to provide a disposable toothbrush that can be easily mass produced, that is simple in design, yet can be used both as a disposable toothbrush or as a more permanent toothbrush.

The preferred embodiment of the disposable toothbrush includes a handle in the form of a hollow small angular book. A foldable neck is integrally attached to the top of the handle along a horizontal fold line. A head is integrally formed in the top of the foldable neck. Bristles are attached to the head of the toothbrush for scrubbing teeth and gums during the operation of the toothbrush.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE DRAWINGS

Figure 1:
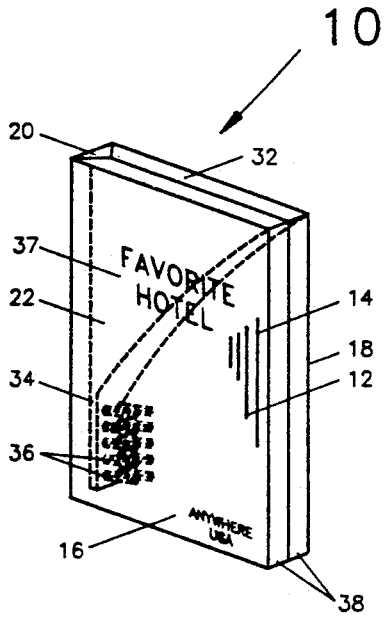
FIG. 1 is a perspective view of the disposable toothbrush with a handle in a closed position.

In FIG. 1 the disposable toothbrush is designated by general reference numeral 10. The toothbrush 10 may be made of plastic or any similar material that can be molded or shaped as shown in the drawings. The toothbrush 10 includes a handle 12 in the form of a small angular-shaped book 14 having a front cover 16 and a back cover 18 and vertical spine 20 joining the two covers 16 and 18.

Shown in dotted lines and folded inside the handle 12 is a neck 22 integrally attached to a top 24 of an inside 26 of the front cover 16 and a top 28 of an inside 30 of the back cover 18. This structure can be seen more closely in FIG. 2. The neck 22 is folded into a closed and down position as shown in FIG. 1 along a horizontal fold line 32.

Also shown in dotted lines in FIG. 1 is a head 34 integrally attached to the top of neck 22. The head 34 includes bristles 36 for receiving toothpaste thereon. Further, an outside 37 of the front cover 16 lends itself for advertising a hotel, motel chain, travel agent, restaurant, or another establishment that wishes to give a guest the subject toothbrush 10 to freshen up or for travel. Note in FIG. 1 the advertising reflects an example of "Favorite Hotel" with an address and phone number of "Anywhere U.S.A.—303-300-0000."

Figure 2:
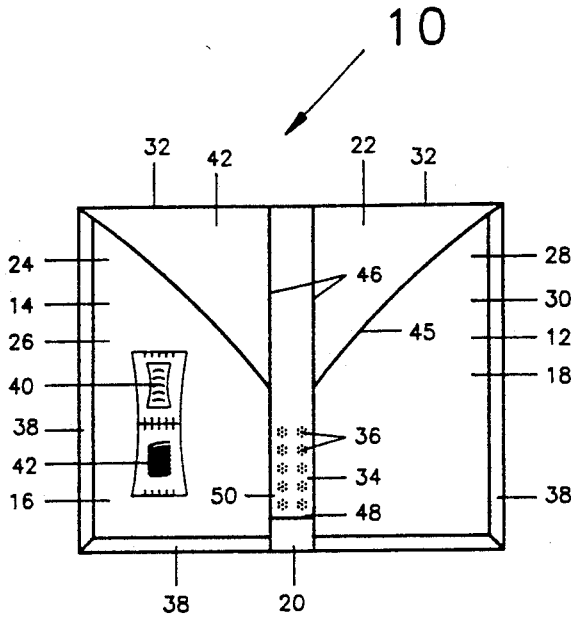
FIG. 2 is a front view of the disposable toothbrush with the handle in a completely open position.

In FIG. 2 the handle 12 is opened completely to expose the folded neck 22 with head 34 therein. In this figure a frame 38 can be seen disposed around the inside edges of the front cover 16 and back cover 18 except for along the fold line 32. The frame 38 helps contain a sealed package 40 of toothpaste and a sealed package 42 of dental floss to go with the toothbrush 10.

The neck 22 as shown in FIG. 2 includes a base 42 along the fold line 32. The base 42 tapers inwardly along semi-circular lines 44 and 45 until it feathers into the bottom of head 34. The neck 22 also includes a pair of vertical folds 46 which extend from the horizontal fold line 32 to opposite sides 48 and 50 of the head 34.

Figure 3:
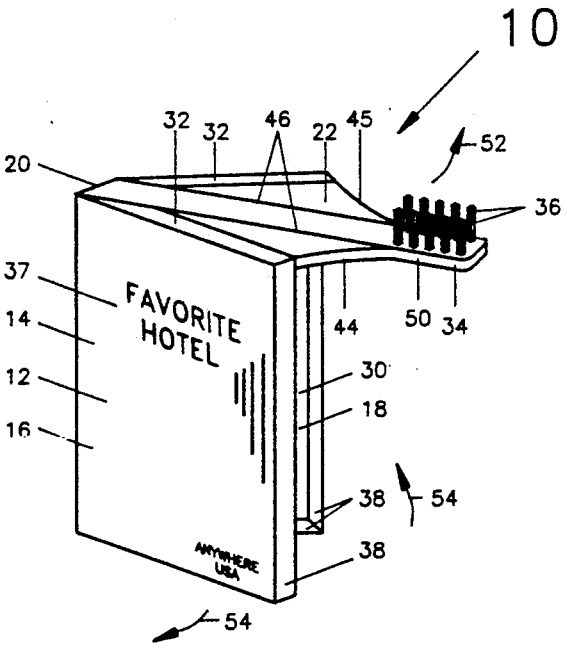
FIG. 3 is a perspective view of the disposable toothbrush with the handle opened and a neck and a head with bristles thereon partially raised.

In FIG. 3 the toothbrush 10 is shown with the handle 12 opened and the neck 22 with head 34 attached in a partially raised position. As the neck 22 is raised upwardly as indicated by arrow 52, the front cover 16 and the back cover 18 are moved toward an inside out position as indicated by arrows 54. By continuing to raise the neck 22 by rotating it along the fold line 32 at the top 24 and 28 of the covers 16 and 18, the neck 22 reaches its raised position as shown in FIG. 4.

Figure 4:
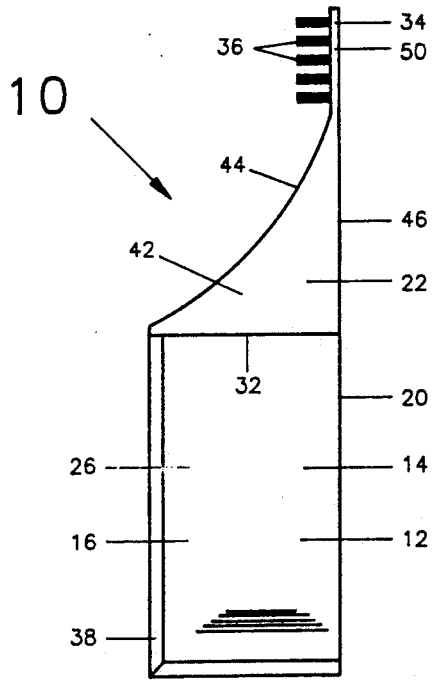
FIG. 4 is a side view of the disposable toothbrush with the neck and the head with bristles completely raised and the handle in an inside out closed position.

In FIG. 4 the neck 22 with head 34 thereon are in a completely raised position and ready for use by the owner of the toothbrush 10. In this position the front cover 16 and back cover 18 have moved to an inside out position with the outside 37 of the front cover 16 indexed against the outside (not shown in the drawings) of the back cover 18. The handle 12 can now be gripped by a hand with a portion of the neck 22 and head 34 inserted into the mouth for brushing teeth with the bristles 36 or massaging the gums. While not shown in this drawing, a snap or clasp can be incorporated in the front cover 16 and back cover 18 to hold the covers securely together while the toothbrush 10 is in use.

By the nature of the construction of the subject toothbrush 10 it can be thrown away after the first use or the head 34 and neck 22 can be folded back into the handle 12 as shown in FIG. 1 and reused at a later date and as often as desired.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as now claimed.

I claim:

1. A disposable toothbrush which can be used once and thrown away and reused as many times as desired, the toothbrush comprising:

a handle having a small angular-shaped book form, the handle having a front cover with an inside and an outside and a back cover with an inside and an outside, the front cover and the back cover fold on a vertical spine of the handle, the insides of the front and back covers adjacent each other when the handle is in a closed position, the outside of the front and back covers adjacent each other when the handle is in a fully open position, the handle further including a frame around a portion of the inside edges of the covers for housing toothpaste and dental floss when the handle is in a closed position;

a tapered neck having a base attached to a top of the handle along a horizontal fold line; and a head having a first end attached to a first end of the neck, the head having bristles attached thereto;

the front and back covers of the handle receiving the neck and the head with bristles therebetween when the neck is folded downwardly on the horizontal fold line of the handle and the handle is in a closed position, the neck and the head with bristles are in a completely raised position when the neck is folded upwardly on the horizontal fold line of the handle and when the handle is in a fully open position.

2. The toothbrush as described in claim 1 wherein the horizontal fold line of the handle extends along a length of the top of the handle with the base of the neck along the length of the horizontal fold line and the neck tapered inwardly from the horizontal fold line of the handle until the first end of the neck merges into the first end of the head.

3. The toothbrush as described in claim 2 wherein the base of the neck tapers inwardly along semi-circular lines until the first end of the neck merges into the first end of the head.

4. The toothbrush as described in claim 1 wherein the neck includes a pair of parallel vertical fold lines centered on the neck and extending from the horizontal fold line of the handle to opposite sides of the first end of the head, the vertical fold lines disposed adjacent the spine of the handle when the neck and head with bristles are folded downwardly on the horizontal fold line of the handle and the handle is in a closed position.

5. The toothbrush as described in claim 4 wherein the bristles on the head are pointed away from and at 90 degrees to the vertical spine of the handle when the neck and the head with bristles are folded downwardly on the horizontal fold line of the handle and the handle is in a closed position.

* * * * *